United States Patent [19]

Gämmerler

[11] Patent Number: 4,840,098

[45] Date of Patent: Jun. 20, 1989

[54] CUTTING KNIFE FOR ROTARY CUTTING APPARATUS FOR PAPER

[76] Inventor: Gunter Gämmerler, Ichoring 44, D-8021 Icking, Fed. Rep. of Germany

[21] Appl. No.: 197,213

[22] Filed: May 23, 1988

[30] Foreign Application Priority Data

Jun. 12, 1987 [DE] Fed. Rep. of Germany ..... 3719721

[51] Int. Cl.[4] ..... B26D 1/143

[52] U.S. Cl. ..... 83/841; 83/675; 83/676; 83/677

[58] Field of Search ..... 83/841, 676, 836, 839, 83/174, 675, 673, 665, 663, 838, 840, 844, 677

[56] References Cited

U.S. PATENT DOCUMENTS 927,436 7/1909 Siscoe ..... 83/675
940,420 11/1909 Ayers et al. ..... 83/676
2,160,525 5/1939 Thornton ..... 83/841
3,813,981 6/1974 Faltin ..... 83/500
3,831,482 8/1974 Eichler et al. ..... 83/675
4,251,198 2/1981 Altenburg ..... 83/675

FOREIGN PATENT DOCUMENTS 3536989 4/1987 Fed. Rep. of Germany .

*Primary Examiner*—Frank T. Yost
*Assistant Examiner*—Rinaldi Rada
*Attorney, Agent, or Firm*—Paul L. Sjoquist

[57] ABSTRACT

A cutting knife for a rotary cutting apparatus for multilayer isolated paper products with projections, for example in tooth form, projecting from a base body. The projections are formed as blades or the like displaceable in or on the base body and inclined with respect to a cutting plane; the faces of the blades lying in the cutting plane can be reground.

8 Claims, 1 Drawing Sheet

CUTTING KNIFE FOR ROTARY CUTTING APPARATUS FOR PAPER

The invention relates to a cutting knife for rotary cutting apparatuses for paper, in particular multilayer separated paper products comprising projections, for example in tooth form, projecting from a base body.

In rotary cutting apparatuses generally circular knives or blades and corresponding counter knives or blades are used for cutting paper products, e.g. in stream or imbricated form. In addition to such cutting knives, blades having radial projections or sawteeth (cf. for example U.S. Pat. No. 3,813,981) are known. All cutting knives of this type can be reground in the cutting face or in the cutting faces but a primary consequence thereof is that the diameter of the cutting face is reduced. In addition, these known cutting knives have not proved themselves particularly because their life is relatively short.

The invention is based on the problem of increasing the life of cutting knives of the type mentioned at the beginning and at the same time ensuring that the particular effective radius of the cutting faces can remain unchanged even after any regrinding is necessary.

This problem is solved according to the invention in that in a cutting knife of the type mentioned at the beginning the projections are formed as blades or the like displaceablly inclined in or on the base body with respect to the cutting plane and that the faces thereof lying in the cutting plane can be reground.

Even after any regrinding, due to the displaceability of the blades, the radius of the grinding face is retained unchanged.

According to a preferred embodiment of the invention the blades or the like are made rectangular in longitudinal section and form the cutting face. Preferably, the blades or the like intersect with the cutting plane at an angle of 10°–22°, preferably 16°.

A requirement for such displaceability of the individual blades is a truncated-conical form of the base body, a series of grooves, possibly in the base body shoulder faces, may be provided to support the respective blades at the rear in their initial position.

According to a preferred embodiment of the invention the blades or the like are mounted displaceably in elongated recesses of the base body.

According to a further modification of the invention the longitudinal axes of the blades or the like make an acute angle with the respective radius of the base body; said angle may be 9°–12°, preferably 9°.

Although the number of blades to be used depends on the size of the cutting knife, it has been found that with a cutting knife having a diameter of for example 32 cm, 35–45, preferably 40 blades, can be distributed along the periphery of the base body.

The blades or the like are expediently about 3–5, preferably 4 mm, thick. Also, the elongated recesses receiving the blades or the like may be offset parallel with respect to a radius associated with them by about 25–31, preferably 28 mm.

Preferably, the blades or the like are held in the elongated recesses by two screw bolts 19 and 20.

It has been found particularly expedient for the blades or the like to consist of a particularly hardened steel differing from the base body. This makes it possible to increase the life of the cutting knife particularly well and the base body can even be used after completely replacing the blades.

An example of embodiment is illustrated schematically in the drawings and will be described in detail hereinafter. In the drawings.

Figure 2:
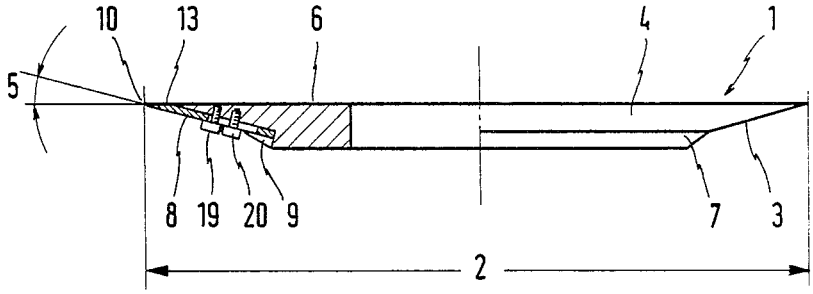
FIG. 2 is a section along the line 2—2 of FIG. 1.
Figure 3:
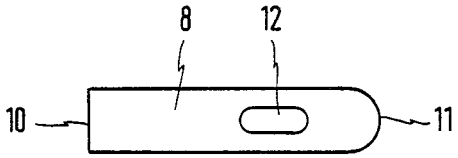
FIG. 3 is a detail to an enlarged scale, also in plan view.

A cutting knife 1 having a diameter 2 of approximately 32 cm is made in the form of a truncated cone as shown in FIG. 2, the face 3 making with the cutting plane 6 an angle 5 of 16°.

The centre rim-like region of the base body 4 comprises a likewise conically extending outer edge face 7 which however, as particularly apparent from FIG. 2, comprises cutouts or recesses 9 in the region of the respective blades 8. The base body 4 consists of a material usual for cutting knives; in comparison, the blades 8 are made with a thickness of 4 mm from a particularly hardened steel.

The blades 8 have in plan view a rectangular cross-section at least with respect to their cutting face 10 whereas at their end 11 pointing towards the centre they may be rounded.

The blades 8 each comprise a slot 12 which as described in more detail below serves to receive screw bolts.

Figure 1:
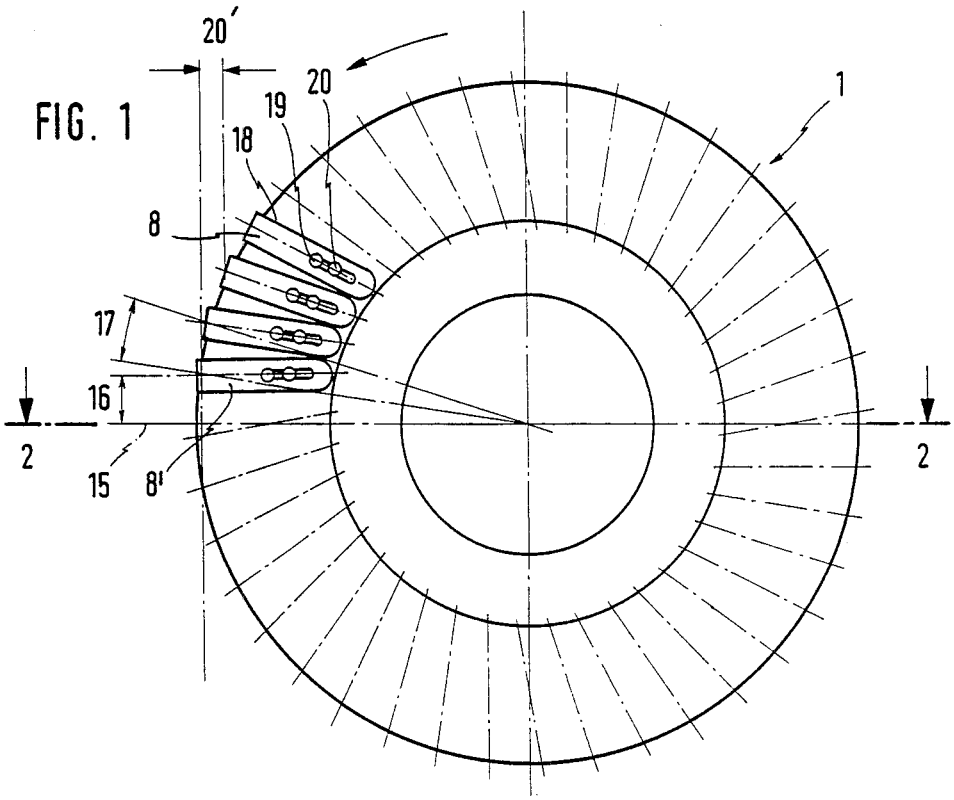
FIG. 1 is a plan view of the this embodiment.

Whereas on the one side the blades 8 project inclined into the base body 4 and their regrindable face 13 thus extends in the cutting plane 6, by inclined positioning of the blades 8 (cf. FIG. 1) with respect to the particular radius a special form of the cutting face is achieved which in this case resembles a tooth shape.

With respect to a radius 15 in the embodiment illustrated the associated blade 8' is offset by 28 mm. This amount is provided with the reference numeral 16.

In the embodiment illustrated 40 blades 8 are provided so that the centre points of the cutting faces of two adjacent blades are spaced respectively by the amounts 17, i.e. 9°.

The blades are displaceably mounted in recesses 18, not shown in detail, in the base body, and in each case two screw bolts 19 and 20 hold the blades in the operative position and ensure the displaceability thereof.

Thus, a dimension 20 of 5 mm magnitude results taking account of the radial spacing from blade centre point to blade centre point.

The cutting knife may be used as an individual knife or, in particular, in rotary cutting apparatuses for multilayer paper products, for example in stream form together with a corresponding counter knife. Said counter knife, formed generally as lower knife, cooperates in the cutting plane 16 with the cutting edge 13 of the individual blades.

I claim:

1. A cutting knife for a rotary cutting apparatus for paper products, comprising a circular-periphery base body having a cutting plane surface on one side and a truncated cone surface on the opposite side; a plurality of blades respectively mounted on said truncated cone surface, each of said blades being adjustably positionalbe to extend beyond said circular periphery and having a blade face in alignment with said base body cutting plane surface.

2. A cutting knife as claimed in claim 1, wherein each of said blades further comprise a cutting edge along one side of a rectangular section.

3. A cutting knife as claimed in claim 2 wherein each of said blades is aligned to intersect said cutting plane surface at an angle of from 10° to 22°.

4. A cutting knife for a rotary cutting apparatus for paper products, comprising a circular periphery base body having a cutting plane surface on one side and a truncated cone surface on the opposite side; a plurality of recesses cut into said truncated cone surface and extending through the circular periphery of said base body; a plurality of blades respectively mounted in said recesses, each blade being adjustably fastened to said base body and having a cutting edge extending beyond the circular periphery of said base body, said blade having a face in alignment with said cutting plane surface.

5. A cutting knife as claimed in claim 4, wherein each of said recesses further comprise a groove along a longitudinal axis, said longitudinal axis being formed at an acute angle relative to a radius line of said base body.

6. A cutting knife as claimed in claim 5, wherein said acute angle is between 9° and 12°.

7. A cutting knife according to any of claims 1–6, wherein said plurality of blades are regularly distributed about said circular periphery.

8. A cutting knife according to any of claim 1–6, wherein each blade further comprises a longitudinal slot, and further comprising at least one fastener through said slot and threadably attached to said base body.

* * * * *